US007010875B1

(12) United States Patent
Perrone

(10) Patent No.: US 7,010,875 B1
(45) Date of Patent: Mar. 14, 2006

(54) MEDAL MOUNTING DEVICE

(76) Inventor: Joseph Anthony Perrone, 912 Latil St., Long Beach, MS (US) 39560

( * ) Notice: Subject to any disclaimer, the term of this patent is extended or adjusted under 35 U.S.C. 154(b) by 1 day.

(21) Appl. No.: 10/909,677

(22) Filed: Aug. 2, 2004

Related U.S. Application Data

(60) Continuation-in-part of application No. 10/629,256, filed on Jul. 28, 2003, now abandoned, which is a division of application No. 09/981,405, filed on Oct. 17, 2001, now Pat. No. 6,622,405.

(51) Int. Cl.
*A44D 3/00* (2006.01)

(52) U.S. Cl. ..... 40/1.5; 40/661.04

(58) Field of Classification Search ..... 40/1.5, 40/1.6, 661.04; 24/55, 60, 63
See application file for complete search history.

(56) References Cited

U.S. PATENT DOCUMENTS 1,377,676 A 5/1921 Gaunt
1,455,143 A * 5/1923 Maurer ..... 40/1.6
1,624,458 A 4/1927 Zook
2,795,064 A * 6/1957 Leonard, Jr. ..... 40/1.5
3,257,747 A 6/1966 Schimmel
4,155,183 A 5/1979 Abrahams
D281,867 S * 12/1985 Swesey et al. ..... D11/98
5,782,022 A 7/1998 Tubberville
6,108,874 A 8/2000 Waas-Russiyan et al.
6,622,405 B1 * 9/2003 Perrone ..... 40/1.5

FOREIGN PATENT DOCUMENTS

GB 2257015 A * 1/1993

* cited by examiner

*Primary Examiner*—Cassandra Davis
(74) *Attorney, Agent, or Firm*—Jack Lo

(57) ABSTRACT

A medal mounting device is comprised of a ribbon with a first end folded into a narrower strip with parallel sides. A second end of the ribbon is attached to a metal clip with foldable tabs. The first end of the ribbon is inserted through a loop attached to a medal and folded behind an intermediate portion of the ribbon. The ribbon is positioned against a medal support bar on a uniform so that the bottom of the medal is aligned with the bottoms of adjacent medals. The second end of the ribbon is folded behind the support bar, and the clip is positioned against the strip at the first end. The tabs are folded around the opposite edges of the strip and pressed against the back of the strip to secure the first end relative to the second end.

3 Claims, 6 Drawing Sheets

MEDAL MOUNTING DEVICE

CROSS REFERENCE TO RELATED APPLICATIONS

This is a continuation-in-part of abandoned patent application Ser. No. 10/629,256 filed on Jul. 28, 2003 now abandoned, which is a division of patent application Ser. No. 09/981,405 filed on Oct. 17, 2001 and issued as U.S. Pat. No. 6,622,405 on Sep. 23, 2003.

BACKGROUND OF THE INVENTION

1. Field of the Invention

This invention relates generally to devices for mounting medals on a uniform.

2. Prior Art:

A military medal is typically comprised of a loop of ribbon, a medallion suspended at a lower end of the ribbon, and an attaching device at the top of the ribbon for attaching to a uniform. Each branch of the military service has specific regulations for the wearing of medals. For example, there are rules that limit number of medals which may be mounted side-by-side on a single row without overlap, the number of medals which may be mounted side-by-side on a single row with overlap, the amount of permissible overlap within a row, the length of the medal from the top of the ribbon to the bottom of the medallion, etc.

Conventional medals are constructed for being attached to a uniform individually. Therefore, they are very difficult to line up properly. If they must be attached onto another uniform, the tedious mounting process must be repeated. Further, the attaching devices prevent them from overlapping. A highly decorated service member can run out of room on the uniform if the medals cannot be overlapped. Service members thus usually pay a medal mounting service or tailor shop to remove the original attaching devices, reconnect the ends of the loop ribbons which come apart after the attaching devices are removed, and attach the medals on a backing with pins, with overlap if necessary. The medals must be remounted every time a new medal is added to the same row.

U.S. Pat. No. 5,782,022 to Tubberville shows a medal mounting device for aligning a plurality of medals along a row and attaching them simultaneously to a uniform. It is comprised of an elongated bar with a channel on the back, and an elongated strip which snaps into the channel. The upper end of a medal ribbon is clamped between the channel and the strip. The ribbon is wrapped around the top of the bar and hung down the front. However, the ribbon shown is a single ply ribbon, not a loop as in a conventional ribbon. A medallion cannot be hung on a single ply ribbon. The mounting bar cannot be used with a conventional loop ribbon, which is not long enough to be clamped inside the bar, wrapped around the top of the bar, and hung down the front of the bar. A specially made ribbon is required.

BRIEF SUMMARY OF THE INVENTION

A medal mounting device is comprised of a ribbon with a first end folded into a narrower strip with parallel sides. A second end of the ribbon is attached to a metal clip with foldable tabs. The first end of the ribbon is inserted through a loop attached to a medal and folded behind an intermediate portion of the ribbon. The ribbon is positioned against a medal support bar on a uniform so that the bottom of the medal is aligned with the bottoms of adjacent medals. The second end of the ribbon is folded behind the support bar, and the clip is positioned against the strip at the first end. The tabs are folded around the opposite edges of the strip and pressed against the back of the strip to secure the first end relative to the second end.

DETAILED DESCRIPTION OF THE INVENTION

Figure 1:
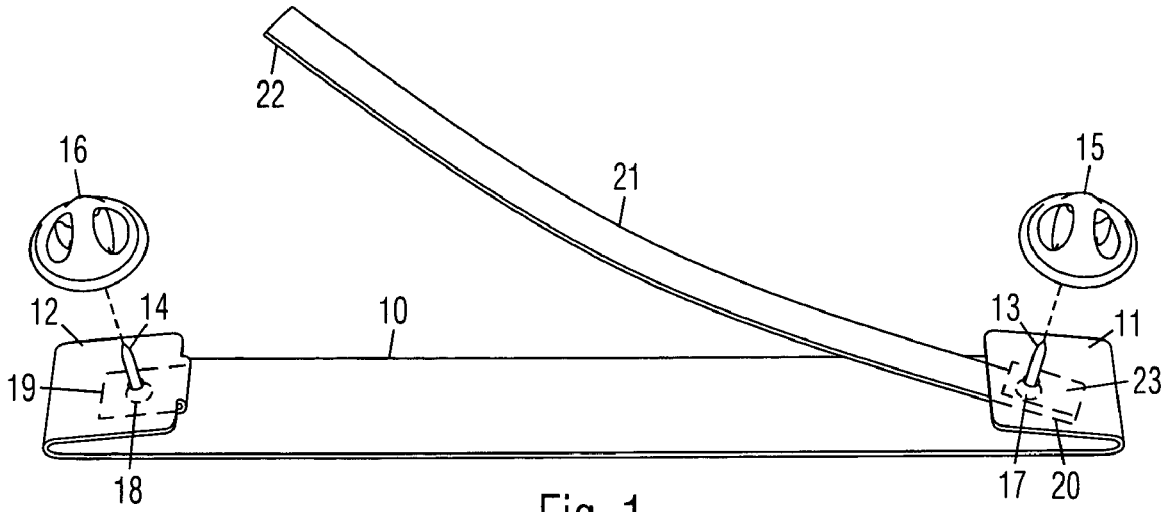
FIG. 1 is a rear perspective view of the present medal mounting device in an open position.
Figure 2:
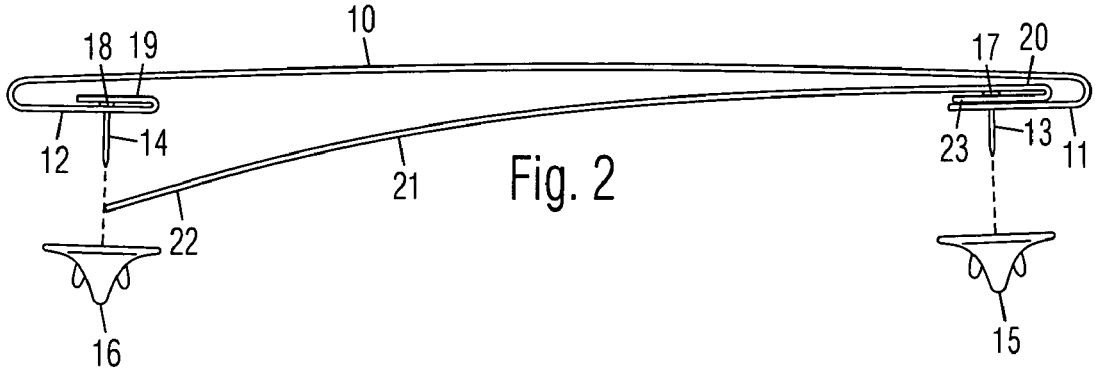
FIG. 2 is a top view of the device of FIG. 1.

FIGS. 1–4:

A first embodiment of the present medal mounting device is shown in a rear perspective view in FIG. 1 and a top view in FIG. 2. It is comprised of an elongated support bar 10 with backwardly recurved first and second ends 11 and 12 that wrap around the back of support bar 10. First and second pins 13 and 14 are respectively attached to recurved ends 11 and 12 and extend rearward. First and second spring clips 15 and 16 are detachably attached to pins 13 and 14. First and second pins 13 and 14 are preferably attached by being positioned through recurved ends 11 and 12, and prevented from falling out by first and second enlarged heads 17 and 18 at their inner ends. Second enlarged head 18 of second pin 14 is secured against an interior surface of second recurved end 12 by a forwardly recurved second tab 19 attached to recurved second end 12 and pressed against head 18. A first end 20 of a springy, forwardly bowed clamping bar 21 is hinged to recurved first end 11 of support bar 10. A free second end 22 of clamping bar 21 is shown pivoted upwardly away from support bar 10. First pin 13 is also positioned through a backwardly recurved first tab 23 at first recurved end 11 of clamping bar 10 and serves as a pivot for clamping bar 21. Enlarged heads 17 and 18 of pins 13 and 14 are covered by clamping bar 21 and recurved second tab 19 and prevented from snagging on medal ribbons. Alternatively, recurved tabs 19 and 23 may be eliminated without allowing pins 13 and 14 to fall out. Pins 13 and 14 may also be attached to the rear surfaces of recurved ends 11 and 12 in other ways, such as by welding.

Figure 3:
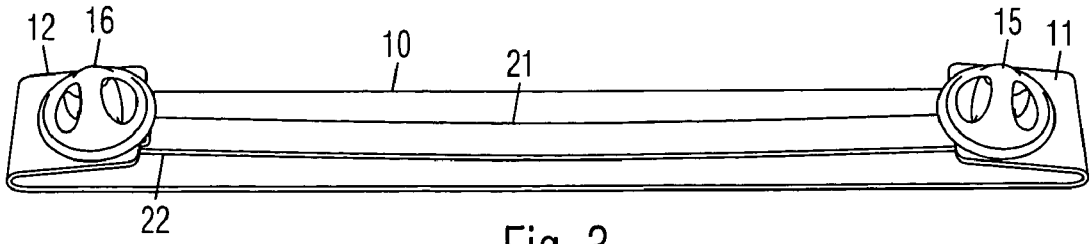
FIG. 3 is a rear perspective view of the device of FIG. 1 in a closed position.
Figure 4:
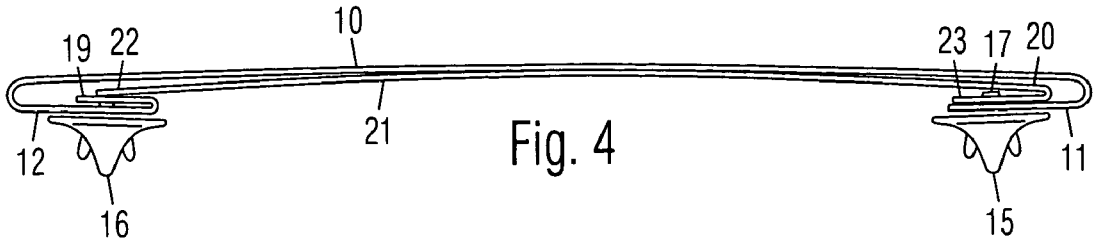
FIG. 4 is a top view of the device of FIG. 3.

Clamping bar 21 is shown in FIGS. 3 and 4 pressed against a rear surface of support bar 10, and free second end 22 tucked under recurved second end 12 of support bar 10. Since clamping bar 21 is forwardly bowed when relaxed, tucking second end 22 under recurved second end 12 of support bar 10 presses clamping bar 21 firmly against a back of support bar 10. Detachable spring clips 15 and 16 are attached to pins 13 and 14.

Figure 5:
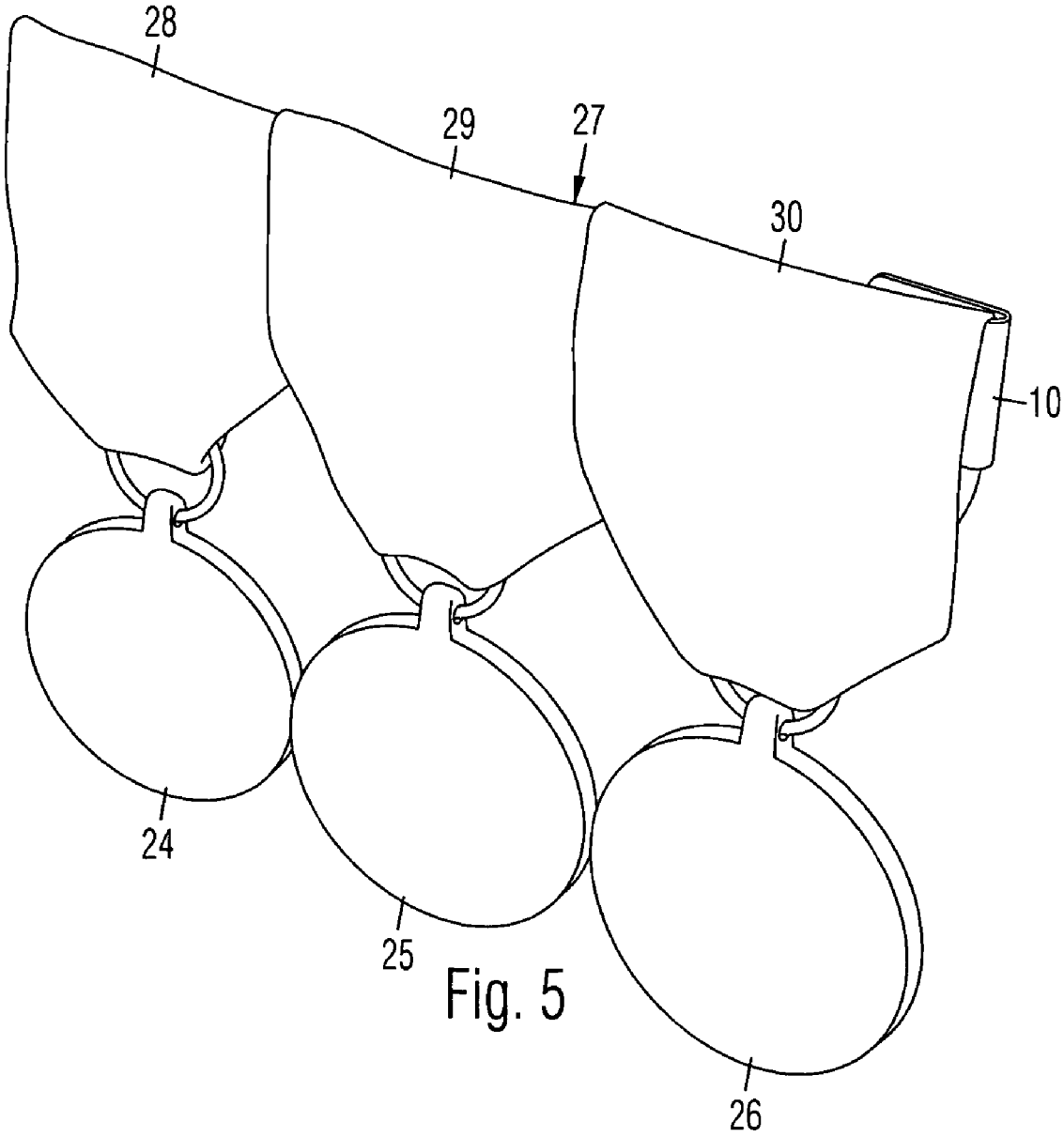
FIG. 5 is a front perspective view of the medal mounting device of FIG. 1 supporting medals in laterally abutting positions.
Figure 6:
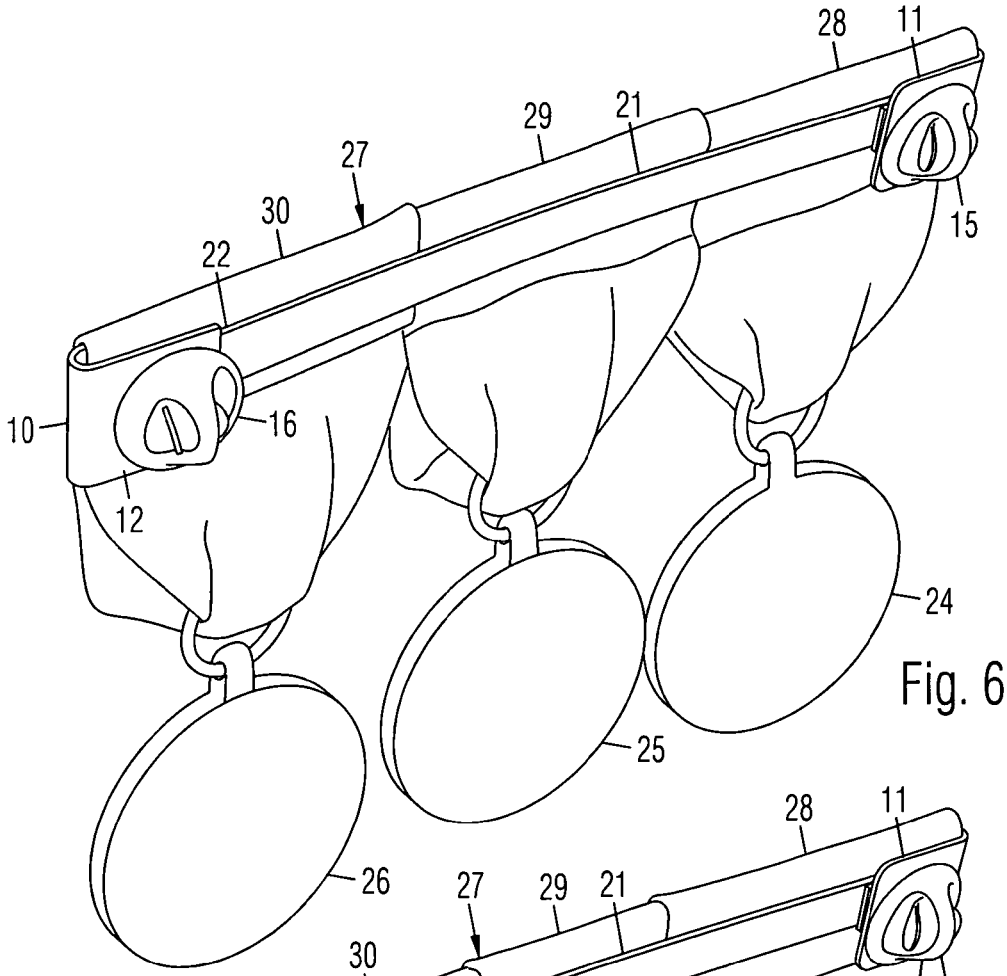
FIG. 6 is a rear perspective view of the device of FIG. 5.

FIGS. 5–7:

A plurality of medals 24–26 are shown supported in a row in laterally abutting positions on the 11 medal mounting device to form a medal assembly 27 in FIGS. 5 and 6. Support bar 10 is positioned through looped ribbons 28–30 of medals 24–26. As shown in FIG. 6, ribbons 28 and 30 at opposite ends of the row are respectively tucked between recurved end 11 and support bar 10, and recurved end 12 and support bar 10. Clamping bar 21 is pressed against the back of ribbons 28–30, and its second end 22 tucked under second recurved end 12 of support bar 10 to clamp ribbons 28–30 in position and prevent them from shifting. Medal assembly 27 may be easily attached to a uniform (not shown) by removing spring clips 15 and 16, inserting the pins (not shown) through the uniform, and attached spring clips 15 and 16 back onto the pins from the inside of the uniform.

Figure 7:
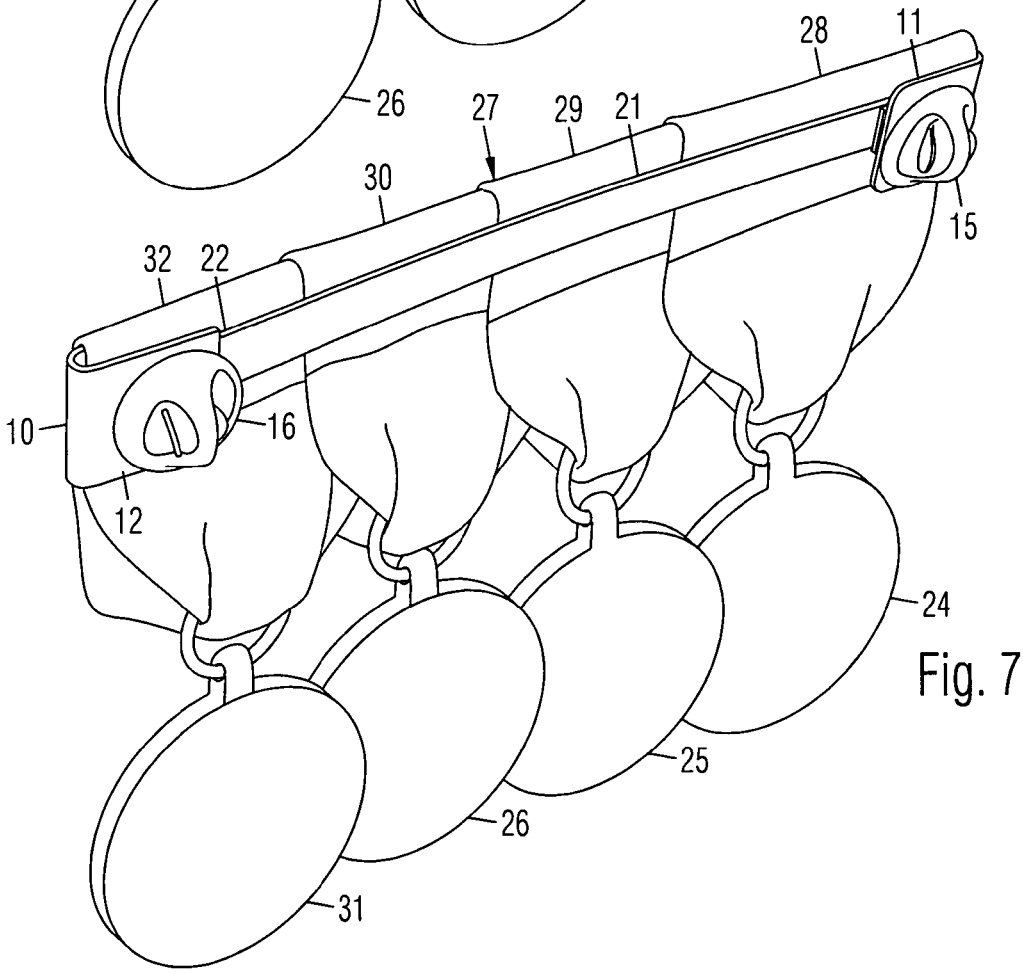
FIG. 7 is a rear perspective view of the medal mounting device of FIG. 1 supporting medals in overlapping positions.

Medals 24–26 and an additional medal 31 are shown in FIG. 7 supported on the medal mounting device in overlapping positions, wherein each successive ribbon is tucked inside a previous ribbon.

In the example shown, ribbons 28–30 and 32 are provided without the permanent attaching device found on prior art medals, so that they can be attached to the present medal mounting device without interfering with clamping bar 21. The ends of ribbons 38–30 and 32 are glued, sewed, or otherwise attached together.

Figure 8:
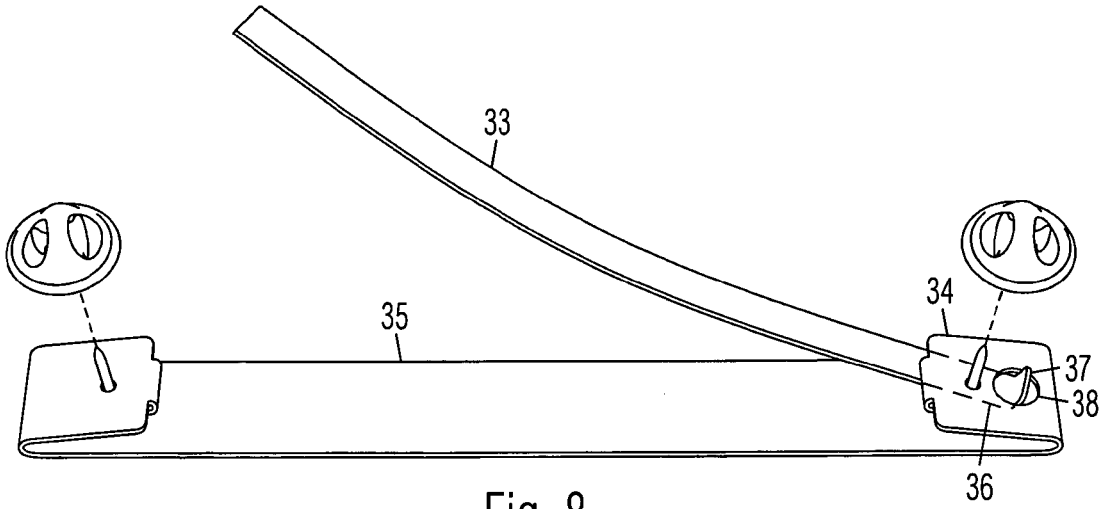
FIG. 8 is a rear perspective view of a second embodiment of the medal mounting device.

FIGS. 8–11:

In a second embodiment of the medal mounting device shown in FIG. 8, a clamping bar 33 is differently hinged to a recurved first end 34 of a support bar 35. A first end 36 of clamping bar 33 is positioned in front of recurved first end 34 of support bar 35, and has a backwardly bent portion or integral pivot 37 projecting through a hole 38 in recurved first end 34.

Figure 9:
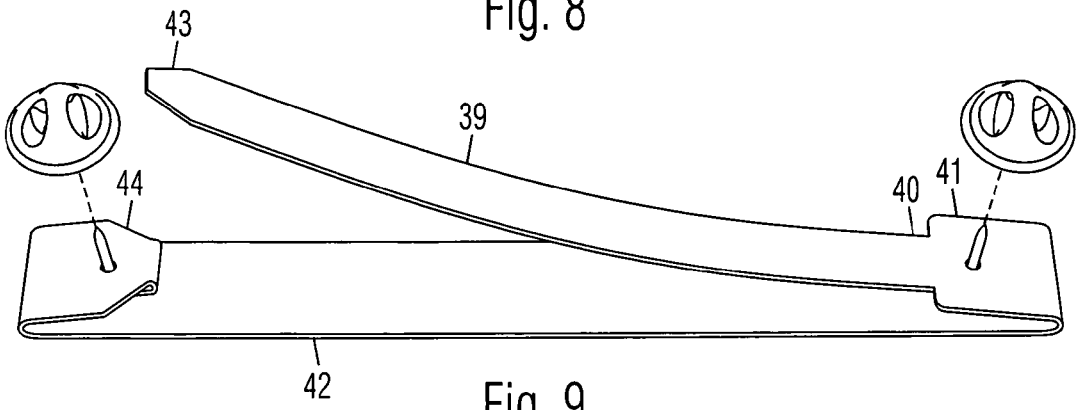
FIG. 9 is a rear perspective view of a third embodiment of the medal mounting device.

In a third embodiment of the medal mounting device shown in FIG. 9, a forwardly bowed clamping bar 39 has a first end 40 integrally attached to a recurved first end 41 of a support bar 42. Although there is no pivot per se, support bar 42 and clamping bar 39 are made of a springy material, such as a soft enough metal, so that a free second end 43 of clamping bar 39 can be moved laterally and tucked under recurved second end 44 of support bar 42. Accordingly, clamping bar 39 is still considered as being hinged to support bar 42 since second end 43 of clamping bar 39 can be moved laterally. Alternatively, clamping bar 39 may be hinged to support bar 42 in other ways.

Figure 10:
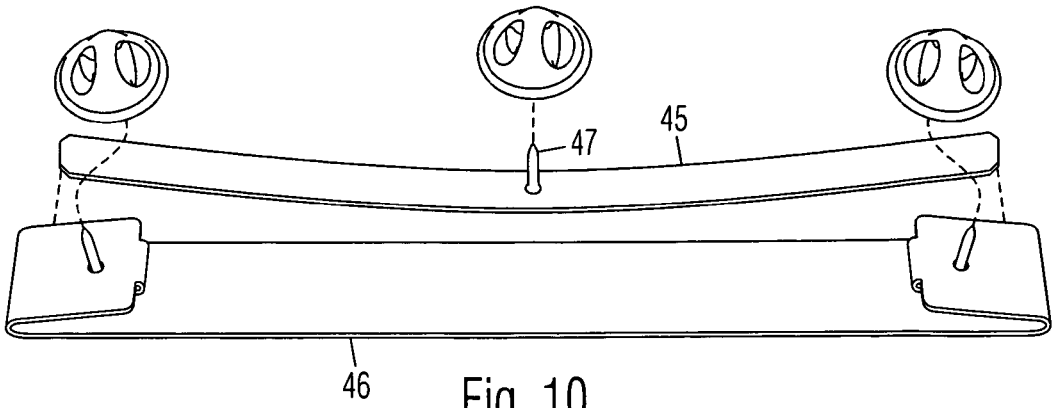
FIG. 10 is a rear perspective view of a fourth embodiment of the medal mounting device.

In a fourth embodiment of the medal mounting device shown in FIG. 10, a forwardly bowed clamping bar 45 is completely separate from a support bar 46. A third pin 47 projects from a back of clamping bar 45 for attaching it to a uniform.

Figure 11:
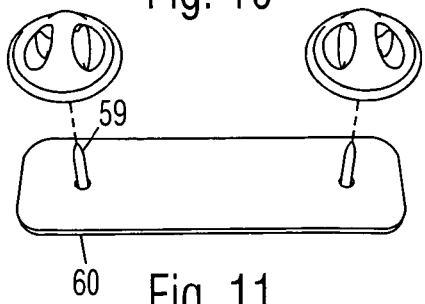
FIG. 11 is a rear perspective view of a fifth embodiment of the medal mounting device.

In a fifth embodiment of the medal mounting device shown in FIG. 11, the clamping bar is omitted, and pins 59 are fixedly attached to non-recurved opposite ends of a support bar 60, such as by welding or cementing. Support bar 60 is preferably sized for supporting for a single medal.

Figure 12:
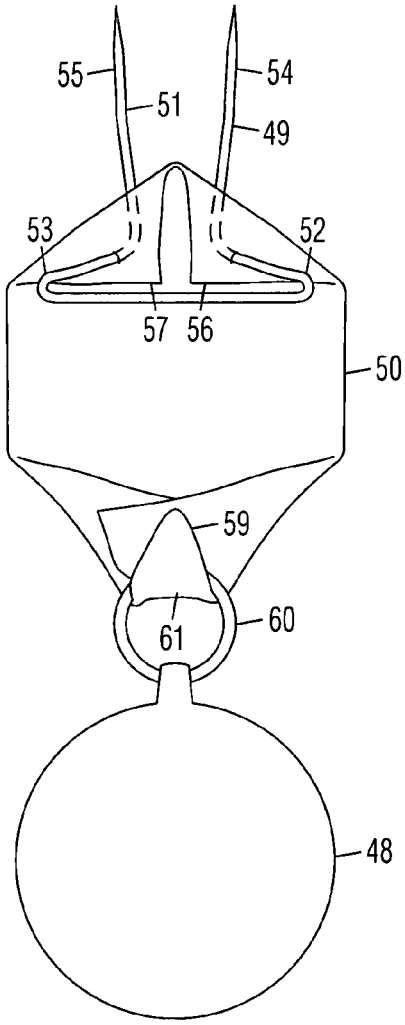
FIG. 12 is a rear view of a sixth embodiment of the medal mounting device.
Figure 13:
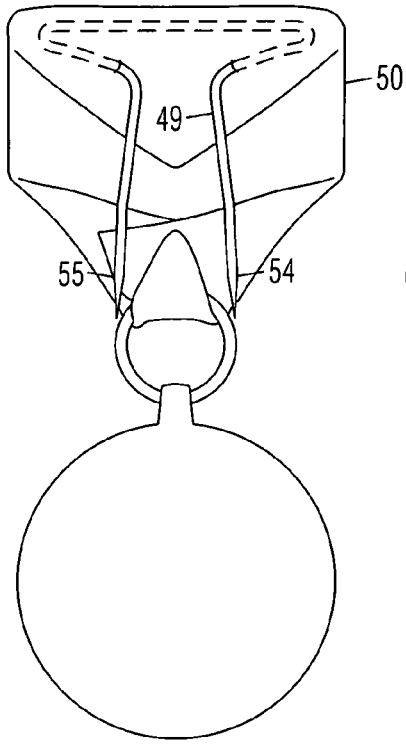
FIG. 13 is a rear view of the device of FIG. 12 in a wearing position.

FIGS. 12–14:

In a sixth embodiment of the mounting device for mounting a single medal 48 shown in FIG. 12, the mounting device is comprised of a T-shaped pin 49 inserted through a ribbon 50 of medal 48. Pin 49 is comprised of a single wire 51 bent to form a "T" shape with horizontal arms 52 and 53, wherein the opposite ends of wire 51 terminate in dual vertical legs 54 and 55. Upper corners 56 and 57 at a top end of ribbon 50 are folded inwardly as shown in FIG. 12, and legs 54 and 55 are inserted through folded corners 56 and 57 from the inside of ribbon 50 and out the opposite side. A lower end 59 of ribbon 50 is inserted through a suspension ring 60 that supports medal 48 and attached to a back side of ribbon 50 to form a small loop 61. To install, ribbon 50 is folded to position pin 49 on its back as shown in FIG. 13, and legs 54 and 55 are inserted in a uniform (not shown).

Figure 14:
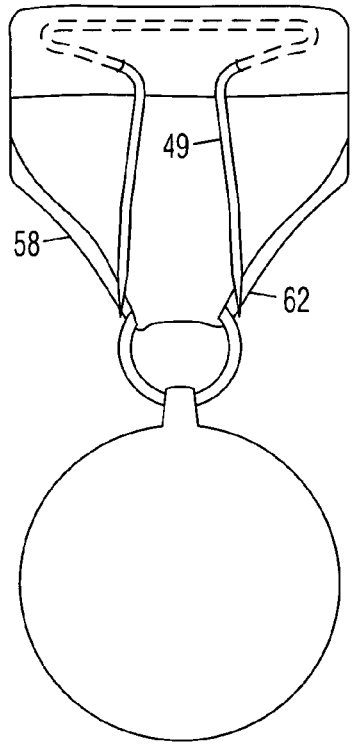
FIG. 14 is a rear view of a seventh embodiment of the medal mounting device.

In a seventh embodiment of the mounting device for mounting a single medal shown in FIG. 14, a ribbon 58 is comprised of a loop with a tapered lower end 62 for supporting the suspension ring of a medal. The opposite ends of the loop are glued or sewn together without any metal fastener, so that it can be used with the present medal mounting device. T-shaped pin 49 is inserted through a back portion of ribbon 58 from inside the loop, so that pin 49 is hidden from view when worn.

Figure 15:
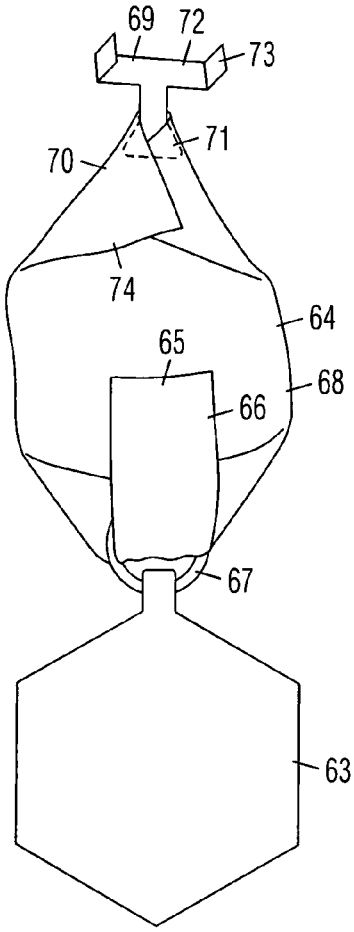
FIG. 15 is a rear view of an eight embodiment of the medal mounting device.

FIGS. 15–17:

An eight embodiment of the mounting device for mounting a single medal 63 is shown in FIG. 15. The mounting device is comprised of a ribbon 64 with a first end 65 folded into a narrower strip 66 with parallel sides. Strip 66 is inserted through a loop 67 attached to medal 63, and folded behind an intermediate portion 68 of ribbon 64. A metal clip 69 is positioned on back of a second end 70 of ribbon 64. Clip 69 includes a generally triangular anchor 71, and a transverse arm 72 attached to an outer end of anchor 71. Foldable tabs 73 project from opposite ends of transverse arm 72. Opposite corners 74 of second end 70 of ribbon 64 are folded inward to enclose and secure anchor 71 to ribbon 64.

Figure 16:
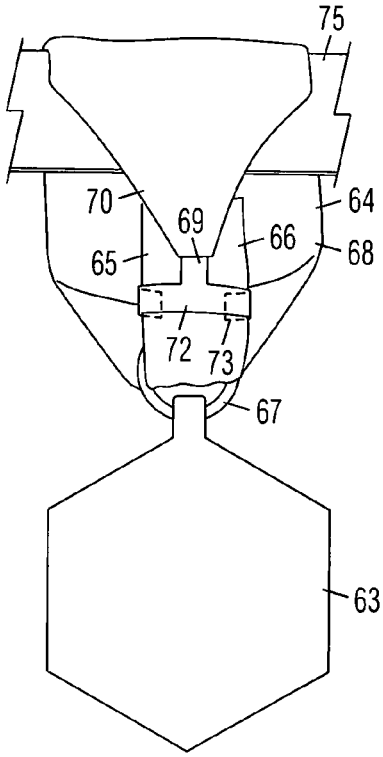
FIG. 16 is a rear view of the device of FIG. 15 in a wearing position.
Figure 17:
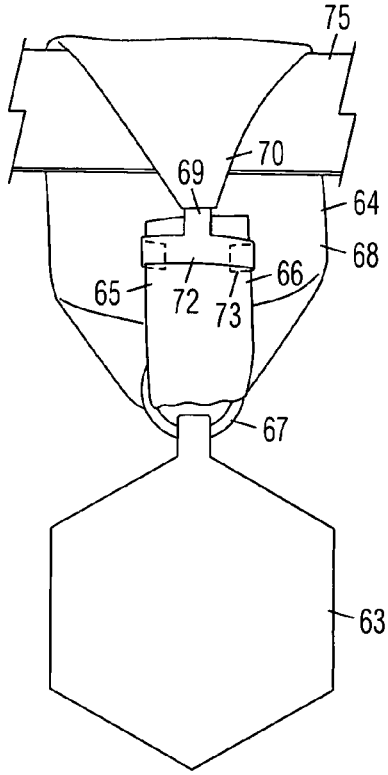
FIG. 17 is a rear view of the device of FIG. 16 with a ribbon adjusted to a longer length.

In FIG. 16, the mounting device is shown attached to a medal support bar 75 attached to a uniform (not shown). Ribbon 64 is positioned against support bar 75 so that the bottom of medal 63 is aligned with the bottoms of adjacent medals (not shown). Second end 70 of ribbon 64 is folded behind support bar 75, and clip 69 is positioned against strip 66. Tabs 73 are folded around opposite edges of strip 66 and pressed against the back of strip 66 to secure first end 65 relative to second end 70. In FIG. 17, clip 69 is secured to a different position along strip 66 to position medal 63 lower. When ribbon 64 sags after prolonged use, ribbon 64 may be adjusted to compensate by loosening clip 69 and reattaching it to a lower point on strip 66.

SUMMARY AND SCOPE

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. The mounting device may be made of any suitable material, such as steel, plastic, etc. Any of the embodiments may be provided with more pins than shown. Therefore, the scope of the invention should be determined by the appended claims and their legal equivalents, not by the examples given.

I claim:

1. A medal mounting device, comprising:

a ribbon with a first end, a second end, and an intermediate portion between said first end and said second end, wherein said first end is for positioning through a loop attached to a medal and positioned behind said intermediate portion; and a clip attached to said second end of said ribbon, wherein said clip is detachably attached to said first end of said ribbon to secure said first end and said second end relative to each other, wherein clip is detachable from said first end and attachable to another position on said first end to adjust a length of said ribbon.

2. A medal mounting device, comprising:

a ribbon with a first end, a second end, and an intermediate portion between said first end and said second end, wherein said first end comprises a strip with generally parallel sides and narrower than said intermediate portion for positioning through a loop attached to a medal and positioned behind said intermediate portion; and a clip attached to said second end of said ribbon, wherein said clip includes an arm attached to said first end, and foldable tabs projecting from opposite ends of said arm and folded around said sides of said strip, so that said second end and said first end of said ribbon are secured relative to each other, wherein said tabs are unfoldable and said clip is attachable to another position on said strip to adjust a length of said ribbon.

3. A medal mounting device, comprising:

a ribbon with a first end, a second end, and an intermediate portion between said first end and said second end, wherein said first end comprises a strip with generally parallel sides and narrower than said intermediate portion for positioning through a loop attached to a medal and positioned behind said intermediate portion, wherein said second end includes inwardly folded opposite corners; and a clip attached to said second end of said ribbon, wherein said clip comprises:

an anchor enclosed by said inwardly folded opposite corners of said second end of said ribbon;

a transverse arm connected to an outer end of said anchor and positioned against said strip; and foldable tabs projecting from opposite ends of said transverse arm and folded around said sides of said strip, so that said second end and said first end of said ribbon are secured relative to each other, wherein said tabs are unfoldable and said clip is attachable to another position on said strip to adjust a length of said ribbon.

* * * * *